US006733278B1

(12) United States Patent
Welden

(10) Patent No.: US 6,733,278 B1
(45) Date of Patent: May 11, 2004

(54) VARIABLE HEAT OUTPUT BURNER ASSEMBLY

(76) Inventor: David P. Welden, 828 Indiana Ave., Iowa Falls, IA (US) 50126

( * ) Notice: Subject to any disclaimer, the term of this patent is extended or adjusted under 35 U.S.C. 154(b) by 0 days.

(21) Appl. No.: 10/225,704

(22) Filed: Aug. 22, 2002

(51) Int. Cl.[7] ..... F23Q 9/00; F23D 14/62

(52) U.S. Cl. ..... 431/183; 431/285; 239/402; 239/403; 239/431; 239/466

(58) Field of Search ..... 431/278, 285, 431/183; 239/402, 403, 427, 466, 431, 434, 427.3

(56) References Cited

U.S. PATENT DOCUMENTS

| | | | | |
|---|---|---|---|---|
| 1,500,012 A | * | 7/1924 | Staples | 239/402 |
| 1,754,828 A | * | 4/1930 | Kelsall | 239/431 |
| 2,065,042 A | * | 12/1936 | Berryman | 239/402 |
| 4,220,444 A | * | 9/1980 | Reed et al. | 431/183 |
| 4,354,481 A | | 10/1982 | Welden | |
| 4,383,820 A | * | 5/1983 | Camacho | 431/183 |
| 4,462,342 A | | 7/1984 | Welden | |
| 4,614,491 A | | 9/1986 | Welden | |
| 5,305,735 A | | 4/1994 | Welden | |
| 5,368,474 A | | 11/1994 | Welden | |
| 6,135,063 A | | 10/2000 | Welden | |
| 6,345,979 B1 | * | 2/2002 | Taylor et al. | 431/285 |

OTHER PUBLICATIONS

Copy–1 sheet entitled Model "400" OVENPAK® Gas Burner—p. 2105 by Maxon Corporation of Muncie, Indiana—date at left–hand corner (bottom) is 10/92.

* cited by examiner

*Primary Examiner*—Sara Clarke
(74) *Attorney, Agent, or Firm*—Sturm & Fix LLP

(57) ABSTRACT

As with most burners and combustors, they utilize fuel and air mixtures. One of the important aspects of burning an air-fuel mixture is that of mixing. Ideally, the fuel should be uniformly distributed throughout the air when ignited. This results in the most complete burn, maximizing beat generation while minimizing unburned and incomplete-combustion products. This disclosure describes an apparatus for enhancing mixing of fuel and air. Combustion air is given a prerotation by passing it through a set of fins before the fuel is injected into the air. Then the mixture is passed through another set of fins, rotating the mixture in a direction opposite that which the air experienced, first.

12 Claims, 2 Drawing Sheets

VARIABLE HEAT OUTPUT BURNER ASSEMBLY

TECHNICAL FIELD

This invention relates generally to an apparatus for mixing air and fuel in a burner. More specifically, the geometry of the flow path of the air and fuel are made to result in maximum mixing of the fuel and air components. The air first passes through a set of fins providing some prerotation to the air before the fuel is admitted. Then the air and fuel mixture passes through another set of fins angled in a direction opposite that of the first set of fins to enhance mixing. Finally, the mixture is exposed to burning fuel, which ignites it.

BACKGROUND ART

To supply heat by combusting fuel, an oxidant is required. In a typical burner application such as those for steam generation, a hydrocarbon fuel is mixed with air and the mixture ignited. When mixing of the fuel and oxidant is complete prior to burning, combustion will be most efficient, resulting in the greatest heat output, uniform heating, and minimum incomplete combustion. If adequate mixing is not attained, the combustion will be less efficient, resulting in less heat output and a greater emission of pollutants, specifically carbon monoxide. "Hot spots" may also result.

The problem is compounded when the burner must be made to allow for variable fuel and air flow rates. Due to varying Reynolds number with changing flow rates, the turbulence intensity and the scales of the eddies are not the same throughout the operating region.

For the reasons given above as well as others, there is an obvious need for a burner that provides maximum mixing of fuel and air for combustion.

DISCLOSURE OF THE INVENTION

A purpose of this invention is to provide an apparatus for mixing gaseous fuel and air in a burner. It incorporates vanes with opposing slopes to enhance mass and momentum transfer associated with turbulent fluid flow. Turbulence is instrumental to obtaining rapid, complete mixing of dissimilar fluids.

The air entering the burner assembly is first given a prerotation by a first set of fins or vanes. After exiting this set of fins, the fuel is introduced radially, into the air through a series of orifices around the circumference of a collar. The two gases then enter another set of fins that are angled in the opposite direction from the first set that the air passed through. This change in rotation direction results in turbulent mixing which prepares the mixture for ignition and consequent complete combustion.

Another aspect of the burner assembly is a carefully sized, small pilot tube that carries combustion air from upstream of the fin assemblies to a "T" in which fuel is added to the air. From there, the mixture passes an ignitor to provide the threshold energy to initiate burning. This small amount of burning mixture enters the main air-fuel mixture downstream of the second set of fins and causes that mixture to combust.

BEST MODE FOR CARRYING OUT THE INVENTION

Figure 1:
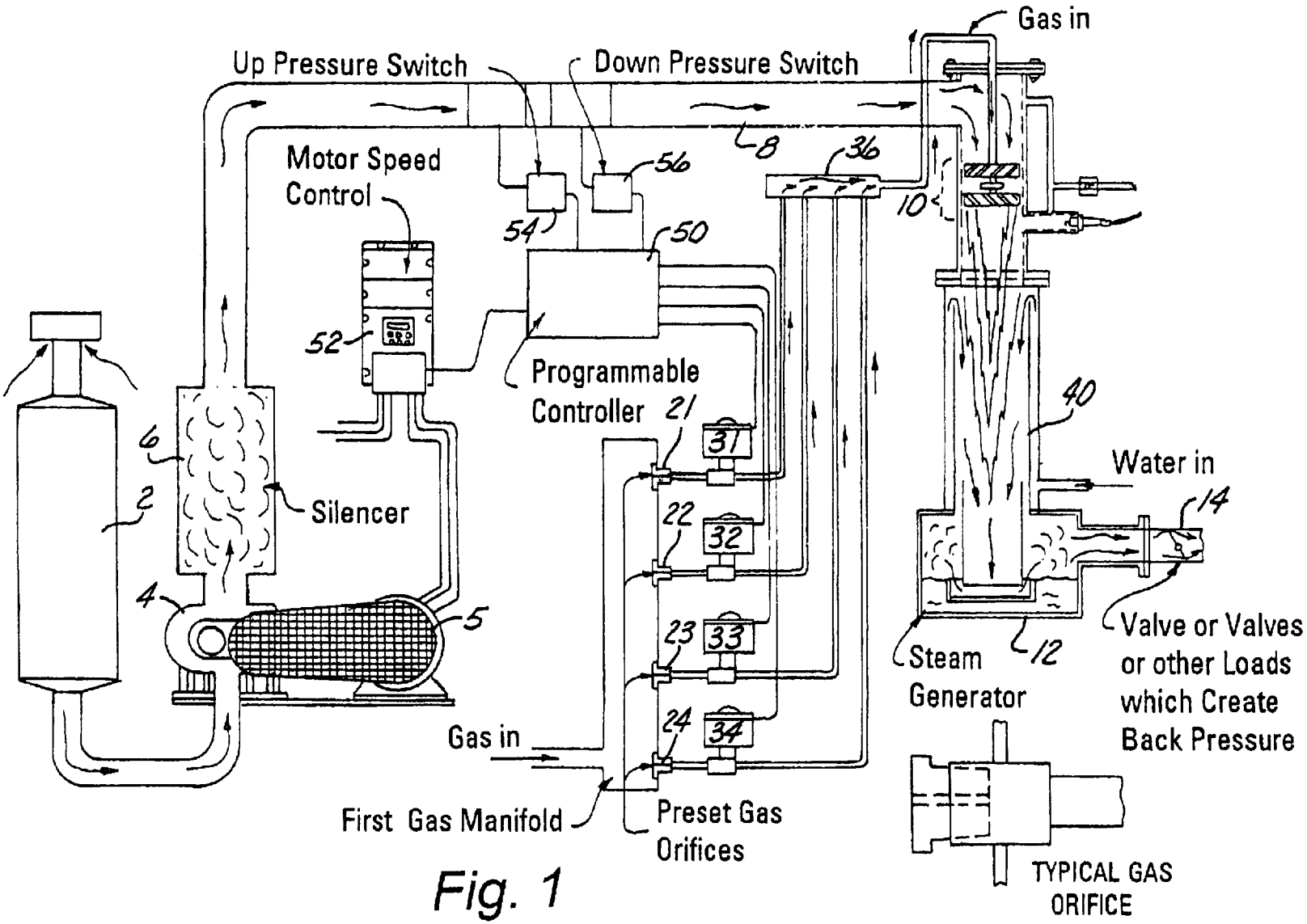
FIG. 1 shows a direct-fired steam generator.

A schematic depiction of a direct-fired steam generator with multiple fuel valves is shown in FIG. 1. Combustion air enters the system at the inlet filter 2 and progresses to blower 4, driven by variable speed electric motor 5. The air exits blower 4 into silencer 6 and through ductwork 8 to burner assembly 10. In burner assembly 10, the air is mixed with fuel and the mixture ignited. The hot, reacting mixture passes into steam generator 12 where preheated liquid water is added. The water increases in temperature and vaporizes. The hot mixture of steam, air, and combustion products exits the steam generator through or into a process for which steam is required. In the case of FIG. 1, the load is shown as valve 14. At the same time, fuel enters into manifold 20 in which a plurality of gas orifices 21–24 have been installed. A plurality of on-off gas valves 31–34, one each corresponding to one gas orifice, dictate whether fuel flows through that orifice. Gas from all the orifices combines in collection chamber 36. A fuel line exits the collection chamber 36 and enters the burner assembly 10 where the fuel and air are mixed before burning.

Liquid water enters a water jacket 40 where it is preheated as it flows through the jacket surrounding the steam generator. It-then pours into the steam generator where it mixes with the hot combustion gases and is vaporizes.

A programmable controller 50 is included in the steam generator assembly. The roles of programmable controller 50 are to open the correct combination of gas valves 31–34 in the correct sequence and to send a rotational speed set point to the motor speed controller 52 corresponding to the open gas valve combination. A table correlating the required blower motor speed to the open valve combination is programmed in programmable controller 50. Motor speed controller 52 controls the speed of blower motor 5 based on the set point received from programmable controller 50.

Figures 2, 3:
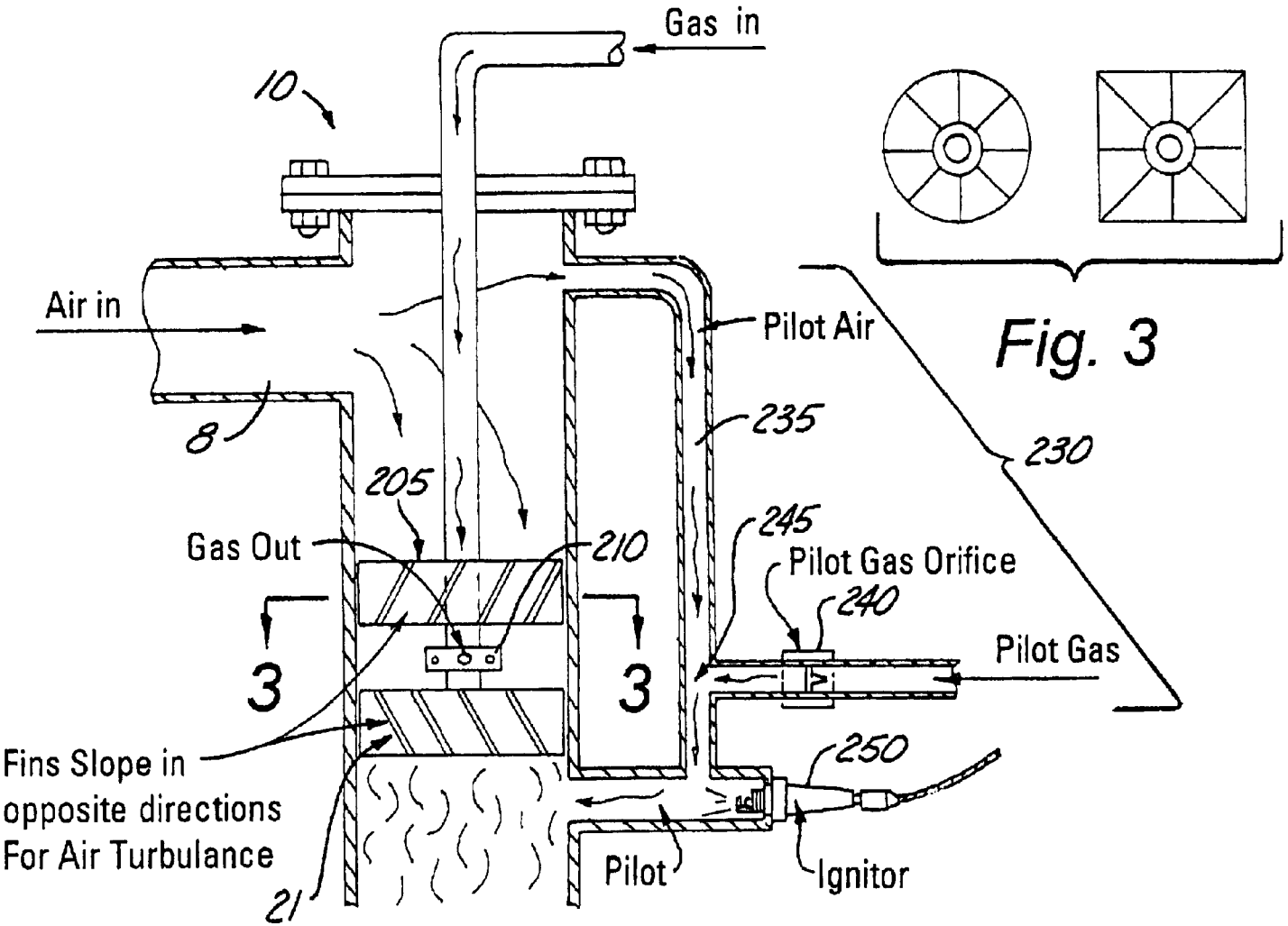
FIG. 2 shows a burner assembly.
FIG. 3 shows two possible fin cross-sections, and is a cross-sectional view taken along line 3—3 of FIG. 2.

The burner assembly 10 is detailed in FIG. 2. The combustion air enters the combustor via duct 8. The majority of the air passes through first fin assembly 205 where some prerotation of the air is initiated. Turbulence intensity also increases along the fin surfaces and in the wakes downstream.

The fuel is introduced downstream of the first fin assembly 205 from injection orifices 210, directed radially. As the air-fuel mixture continues downstream, it enters a second fin assembly 215 providing an opposite rotation to the mixture compared to the first fin assembly. The change in momentum of the fluid is caused by and results in shearing and normal stresses. The shearing stresses cause rotation of the fluid, which enhances mass and momentum transfer, and thus, mixing.

Downstream of the second fin assembly 215, the mixture encounters burning gases from the pilot assembly 230, which causes the mixture to begin burning.

A small amount of air (pilot air) entering the burner assembly 10 bypasses the fin assemblies by entering into the pilot assembly 230. Passing through inlet tube 235, the air encounters fuel (pilot gas) coming from pilot gas orifice 240. The two fluids mix in "T" 245 and continue downstream to ignitor 250 where the mixture is ignited by a spark or high temperature electrode. The burnt and burning mixture exits pilot assembly 230 and enters a region downstream of the second fin assembly 215, where it encounters the main flow of air-fuel mixture. The hot and burning gases from the pilot assembly 230 ignite the air-fuel mixture coming from second fin assembly 215. Because of the complete mixing caused by the turbulence due to the fin assemblies, complete combustion results.

FIG. 3 shows that the cross-section of the first and second fin assemblies 205 and 215, respectively, can be round or polygonal (e.g. rectangular). Many other possible shapes are valid as well, and this invention is not limited to any particular cross-sectional shape. The shape of the first fin assembly 205 could even be different from the shape of the second fin assembly 215.

Obviously many modifications and variations of the present invention are possible in light of the above teachings. It is, therefore, to be understood that within the scope of the appended claims, the invention may be practiced otherwise than as specifically described.

I claim:

1. A burner apparatus for causing a complete mixing of fuel and air in a burner assembly, the apparatus comprising:

(a) a first fin assembly for giving air a prerotation;

(b) a fuel injection downstream of said first fin assembly; and (c) a second fin assembly, entirely downstream of the fuel injection, for causing a rotation of the air and fuel in a direction opposite that caused by the first fin assembly.

2. The apparatus of claim 1 wherein the burner apparatus also comprises a pilot assembly comprising:

(a) a pilot inlet in which air is admitted, upstream of the first fin assembly, into the pilot assembly;

(b) a pilot gas orifice through which fuel is metered into the pilot assembly to mix with the air;

(c) an ignitor, to cause a fuel and air mixture in the pilot assembly to combust; and (d) a pilot exit from which the burning and burnt mixture returns to the main flow of air and fuel downstream of the second fin assembly.

3. The apparatus of claim 1 wherein the fuel is gaseous fuel and is injected from orifices oriented radially outward from a fuel line.

4. The apparatus of claim 1 wherein cross sections of the fin assemblies are round.

5. The apparatus of claim 1 wherein cross sections of the fin assemblies are elliptic.

6. The apparatus of claim 1 wherein cross sections of the fin assemblies are polygonal.

7. A method for causing a complete mixing of fuel and air in a burner assembly comprising first and second fin assemblies, and a fuel injection, the method comprising:

(a) giving the air a prerotation in the first fin assembly;

(b) injecting fuel from the fuel injection downstream of said first fin assembly; and (c) rotating the air and fuel in the second fin assembly, located entirely downstream of the fuel injection resulting in a rotation of the air and fuel in a direction opposite that caused by the first fin assembly.

8. The method of claim 7 wherein the burner apparatus also comprises a pilot assembly, the method comprising:

(a) admitting air into a pilot inlet upstream of the first fin assembly;

(b) metering fuel through a pilot gas orifice into the pilot assembly to mix with the air;

(c) igniting an air-fuel mixture with an ignitor, causing the air-fuel mixture in the pilot assembly to combust; and (d) returning the burning and burnt air-fuel mixture to the main flow of air and fuel downstream of the second fin assembly through a pilot exit.

9. The method of claim 7 wherein the fuel is a gaseous fuel and is injected from orifices oriented radially outward from a fuel line.

10. The method of claim 7 wherein cross sections of the fin assemblies are round.

11. The method of claim 7 wherein cross sections of the fin assemblies are elliptic.

12. The method of claim 7 wherein cross sections of the fin assemblies are polygonal.

* * * * *